US010980360B2

(12) United States Patent
Gschwind et al.

(10) Patent No.: US 10,980,360 B2
(45) Date of Patent: Apr. 20, 2021

(54) MIST-DIFFUSING HEAD PROVIDED WITH A DEFLECTOR

(71) Applicant: Areco Finances Et Technologie—ARFITEC, Grasse (FR)

(72) Inventors: Michel Gschwind, Grasse (FR); Julien Dubois, Golfe Juan (FR); Abbas Sabraoui, Grasse (FR)

(73) Assignee: ARECO FINANCES ET TECHNOLOGIE—ARFITEC, Grasse (FR)

( * ) Notice: Subject to any disclaimer, the term of this patent is extended or adjusted under 35 U.S.C. 154(b) by 0 days.

(21) Appl. No.: 15/036,468

(22) PCT Filed: Nov. 13, 2014

(86) PCT No.: PCT/FR2014/052894
§ 371 (c)(1),
(2) Date: May 13, 2016

(87) PCT Pub. No.: WO2015/075352
PCT Pub. Date: May 28, 2015

(65) Prior Publication Data

US 2016/0286984 A1 Oct. 6, 2016

(30) Foreign Application Priority Data

Nov. 19, 2013 (FR) ..... 1361356

(51) Int. Cl.
*B05B 1/14* (2006.01)
*B05B 1/26* (2006.01)
(Continued)

(52) U.S. Cl.
CPC ..... *A47F 3/0495* (2013.01); *A47F 3/001* (2013.01); *A47F 7/0071* (2013.01); *B05B 1/14* (2013.01);
(Continued)

(58) Field of Classification Search
CPC ..... A47F 3/0495; A47F 3/001; A47F 7/0071; B05B 1/14; B05B 1/265; B05B 1/3026; B05B 1/267; B05B 7/0012
(Continued)

(56) References Cited

U.S. PATENT DOCUMENTS 964,946 A * 7/1910 Vacher ..... B60H 1/3428 239/503
1,863,914 A * 6/1932 Tyler ..... A23N 12/02 239/122
(Continued)

FOREIGN PATENT DOCUMENTS

FR 2971954 A1 * 8/2012 ..... B05B 17/0607
FR 2981585 A1 4/2013
(Continued)

OTHER PUBLICATIONS

Preliminary Search Report and Written Opinion dated May 24, 2016 for corresponding application No. PCT/FR2014/052894.
(Continued)

*Primary Examiner* — Joseph A Greenlund
(74) *Attorney, Agent, or Firm* — Harness, Dickey & Pierce, P.L.C.

(57) ABSTRACT

The invention relates to a mist-diffusing head for a spraying apparatus, which comprises: a mouth for supplying mist to the head; an outer wall having at least one mist outlet opening; at least one seal capable of sealing the opening; and a deflector connected to the wall separately from the seal and having a main surface opposite the mouth with at least one portion arranged in a direction other than the direction of the mouth, a larger portion of the opening or of at least one of the openings extending opposite the deflector.

12 Claims, 6 Drawing Sheets

(51) Int. Cl.

| | |
|---|---|
| ***B05B 1/30*** | (2006.01) |
| ***B05B 1/16*** | (2006.01) |
| ***A47F 3/04*** | (2006.01) |
| ***B05B 7/00*** | (2006.01) |
| ***A47F 3/00*** | (2006.01) |
| ***A47F 7/00*** | (2006.01) |

(52) U.S. Cl.
CPC ..... *B05B 1/1681* (2013.01); *B05B 1/265* (2013.01); *B05B 1/3026* (2013.01); *B05B 7/0012* (2013.01)

(58) Field of Classification Search
USPC ..... 239/518, 500, 505, 514, 533.5, 562; 222/142.8
See application file for complete search history.

(56) References Cited

U.S. PATENT DOCUMENTS 1,951,587 A * 3/1934 Tyler ..... B05B 1/265 239/103
2,038,464 A * 4/1936 Wood ..... A47F 7/0071 211/127.1
2,066,312 A * 1/1937 Bates ..... A47F 3/0495 62/256
2,077,725 A * 4/1937 Tyler ..... B05B 1/267 239/122
2,172,331 A * 9/1939 Christensen, Jr. .... A47F 3/0495 211/127.1
3,030,032 A * 4/1962 Luhman, Jr. ..... B05B 3/0486 239/222.17
3,529,941 A * 9/1970 Warner ..... B01J 4/001 134/22.1
4,114,813 A * 9/1978 Suga ..... B05B 1/14 239/500
4,436,160 A * 3/1984 Ragailler ..... A62C 35/02 169/74
4,569,485 A * 2/1986 Walto ..... B05B 1/265 239/456
5,224,652 A * 7/1993 Kessler ..... A63G 31/007 239/211
5,232,157 A * 8/1993 Laffrey ..... B05B 3/0486 239/222.17
5,350,117 A * 9/1994 Kleinberger ..... A47F 3/001 239/428.5
6,450,265 B1 * 9/2002 Ponte ..... A62C 37/11 169/37
7,216,817 B2 * 5/2007 Turk ..... B05B 3/0481 239/230
8,668,153 B2 * 3/2014 Johnson ..... B05B 1/267 239/1
9,168,541 B2 * 10/2015 Hung ..... B05B 1/28
9,504,277 B2 * 11/2016 Gschwind ..... A47F 3/001
9,533,314 B2 * 1/2017 Davranche ..... B05B 15/65
2008/0251611 A1 * 10/2008 Delattre ..... F24F 5/0035 239/463
2009/0072052 A1 * 3/2009 Gillette ..... A23L 3/3589 239/399
2012/0067974 A1 * 3/2012 Davranche ..... A47F 7/0078 239/200
2015/0021415 A1 * 1/2015 Avila ..... A62C 37/08 239/518
2015/0223513 A1 8/2015 Gschwind et al.
2015/0230625 A1 * 8/2015 Gschwind ..... A47F 3/001 426/506
2016/0286984 A1 * 10/2016 Gschwind ..... B05B 1/265

FOREIGN PATENT DOCUMENTS

WO WO-2010/106276 A1 9/2010
WO WO-2014/044971 A1 3/2014

OTHER PUBLICATIONS

International Search Report PCT/ISA/210 for International Application No. PCT/FR2014/052894 dated Mar. 13, 2015.

* cited by examiner

MIST-DIFFUSING HEAD PROVIDED WITH A DEFLECTOR

CROSS-REFERENCE TO RELATED APPLICATIONS

This application is the U.S. National Phase application of PCT Application No. PCT/FR2014/052894 filed on Nov. 13, 2014, which claims priority to French Patent Application No. 1361356 filed on Nov. 19, 2013, the contents of each of which are incorporated herein by reference.

The invention relates to installations for diffusing a mist of liquid droplets nebulized over products.

Document WO-2010/106276 in the name of the applicant discloses such an installation, which is used for example for a display of food products in a sales outlet. The installation comprises diffusers which project a mist of water micro-droplets above the products, thereby conserving their freshness, improving their appearance and encouraging their sale.

The installation comprises notably a pole that is supplied with mist and bears a plug at its top. The plug has internal ducts that come into coincidence with the orifices in the pole in order to allow the diffusion of the mist to the outside. If the plug is turned, this coincidence is eliminated and so the diffusion is interrupted. The plug also comprises an internal deflector which modifies the orientation of the mist in order for it to exit the pole at a correct speed and in a correct direction.

Notwithstanding its numerous advantages, such a plug is not very flexible with regard to regulating the diffusion of the mist over the products. Moreover, it is relatively expensive to produce on account of its solid nature.

It is an aim of the invention to regulate the diffusion of the mist over the products in a more flexible manner and to reduce the cost of the installation.

To this end, the invention provides a mist diffusing head for a nebulizing installation, which comprises:

a mouth for supplying the head with mist, an external wall that has at least one mist outlet orifice, at least one closing means that is able to close the orifice, and a deflector that is connected to the wall independently of the closing means and has, opposite the mouth, a main face that has at least one portion oriented in a direction other than the direction of the mouth, a majority of the orifice or of at least one of the orifices extending opposite the deflector.

Thus, by virtue of the presence of the deflector, the jet of mist exits the head in an appropriate direction and at an appropriate speed. Specifically, the deflector reduces the turbulence and recirculation inside the head and consequently pressure drops and losses of water. This largely conserves the speed of the mist passing through the head. In this way, the mist exits the latter at a relatively high speed, thereby allowing the droplets to reach products at a distance from the head.

In addition, since the deflector is produced separately from the one or more closing means, it is easily possible to adapt the deflector, the orifice(s) and the one or more closing means, for example depending on the particular features of the installation. Notably, the shape of the deflector can be chosen depending on the desired speed and the desired direction of the jet of mist. Moreover, it is not necessary to equip the head with a solid component such as the above-mentioned prior art plug. Manufacturing is thus easier and its cost reduced.

Furthermore, while the abovementioned prior art plug makes it necessary to give the pole a particular geometry, the invention makes it possible to equip diffusion heads of very different models with a deflector. It is applicable notably to existing heads.

Preferably, the orifice or at least one of the orifices extends entirely opposite the deflector.

In this way, pressure drops are reduced when the jet of mist exits the orifice and losses of water are also reduced by the reduction in the area of impact with the deflector.

Advantageously, the deflector has an axisymmetrical shape.

Provision can be made for it to have, opposite the orifice or at least one of the orifices, a face with a curved profile in a radial plane with respect to a main axis of the deflector.

Advantageously, the profile does not have any point of inflection.

Preferably, it has a parabolic shape.

In one embodiment, the deflector has, opposite the orifice or at least one of the orifices, a face with a convex profile in a radial plane with respect to a main axis of the deflector.

In another embodiment, the profile of this face is concave.

Advantageously, the orifice or at least one of the orifices is oriented downward.

This orientation makes it possible to direct the mist directly toward the products when the latter are situated at a height lower than that of the head.

Advantageously, the head comprises a cover, the deflector being fixed directly, and preferably rigidly, to the cover.

Preferably, the head does not have any means for closing the mouth for supplying the head with mist.

In one embodiment, it comprises at least one fastening element that extends all the way through the deflector along a main axis of the latter.

In another embodiment, it comprises at least one fastening element that extends into a blind housing in the deflector.

Provision can be made for the deflector to have a bottom end that extends above the mouth.

Thus, when liquid collects by condensation on the deflector, it flows via the bottom end thereof directly into the mouth, and not out of the head through the orifice or one of the orifices.

Preferably, the closing means or at least one of the closing means is mounted in a movable manner with respect to the orifice, being guided between the deflector and a cover of the head.

Advantageously, there are at least two orifices that are each able to put the mouth into communication with the outside of the head, there being at least two closing means that are able to close the respective orifices, each closing means being able to close one of the orifices, the closing means being mounted in a movable manner with respect to the wall independently of one another.

Thus, each of the orifices can be closed or opened independently of the other(s). The choice of the number of open orifices makes it possible to regulate the quantity of mist diffused over the products. In addition, the possibility of opening one orifice rather than another makes it possible to orient the diffusion of the mist in the desired direction, for example in the direction of some products and not toward others. This regulation can be modified easily at any time by closing some of the orifices and opening others. The head thus provides great flexibility for the regulation of the intensity and the orientation of the jet(s) of mist.

Advantageously, the deflector comprises a plastics material, for example polytetrafluoroethylene.

The invention also provides a mist diffusing head for a nebulizing installation, which comprises:

a mouth for supplying the head with mist, an external wall that has at least one mist outlet orifice, the head not having means for closing the orifice, and a deflector that has, opposite the mouth, a main face that has at least one portion oriented in a direction other than the direction of the mouth.

Advantageously, the head does not have means for closing the mouth for supplying the head with mist.

The invention also provides an installation for diffusing a mist of droplets, which comprises at least one head according to the invention.

Finally, the invention provides a method for diffusing a mist of droplets onto products, wherein use is made of at least one head according to the invention and/or at least one installation according to the invention.

Several embodiments of the invention will now be presented by way of nonlimiting examples and with reference to the appended drawings, in which.

PRESENTATION OF THE INSTALLATION

Figure 1:
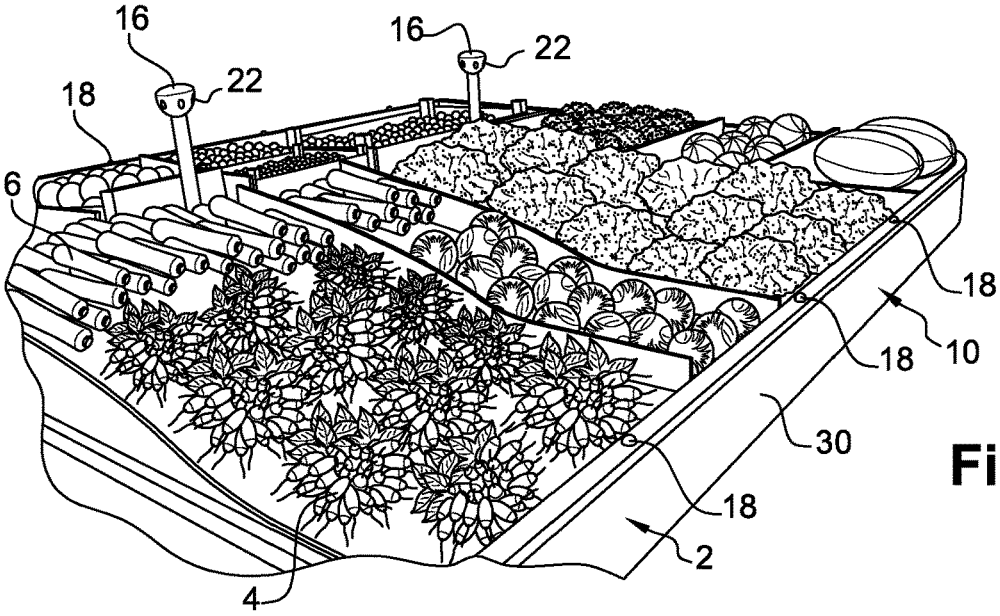
FIGS. 1 to 3 are three perspective views of a presentation display of products that is equipped with a nebulizing installation according to one embodiment of the invention.

FIGS. 1 to 11 illustrate an installation 2 for presenting food products. Here, it is a piece of furniture that in this case forms a table. In the present example, this piece of furniture is used in a product sales outlet.

The products are in this case fresh products consisting of vegetables 4, 6. The invention is also usable for other fresh food products such as fruit, meat or fish. It is also applicable to food products such as cheese and more generally to any product that is liable to dry out, for example flowers.

The piece of furniture, which in this case forms a display stand, comprises a frame 8 and a display 10 that rests on the frame and has in this case a rectangular shape in plan view. The display 10 comprises a bottom wall 12. The display stand is upwardly open such that the products can be looked at or picked up by customers passing near the display stand.

The piece of furniture 2 comprises means for diffusing a mist of nebulized water droplets above and onto the products in order to conserve the freshness thereof. To this end, the piece of furniture 2 comprises notably diffusers 16, of which there are two in this case. They each extend in the mid part of the display stand, away from the periphery thereof.

The diffusers 16 are mutually identical. They are each placed at the top of a cylindrical rectilinear vertical pole 20 having a circular cross section. They comprise a head 22 that extends at the upper end of the pole. The head is closed except for orifices 24. The latter extend for example between 0 and 1 meter above the display. In the present example, the two diffusers are separated from one another by a distance of a meter. It is advantageous for the orifices to be situated at a height, for example around 0.3 m above the products to be wetted, or around 0.5 m from the bottom of the display, but this depends on the actual height of the products. It is advantageous in this regard for the diffusers to be vertically adjustable.

The installation can also comprise diffusers 18 situated on strips 30 that form the periphery of the display stand, surrounding the bottom wall 12 on all sides.

Figure 2:
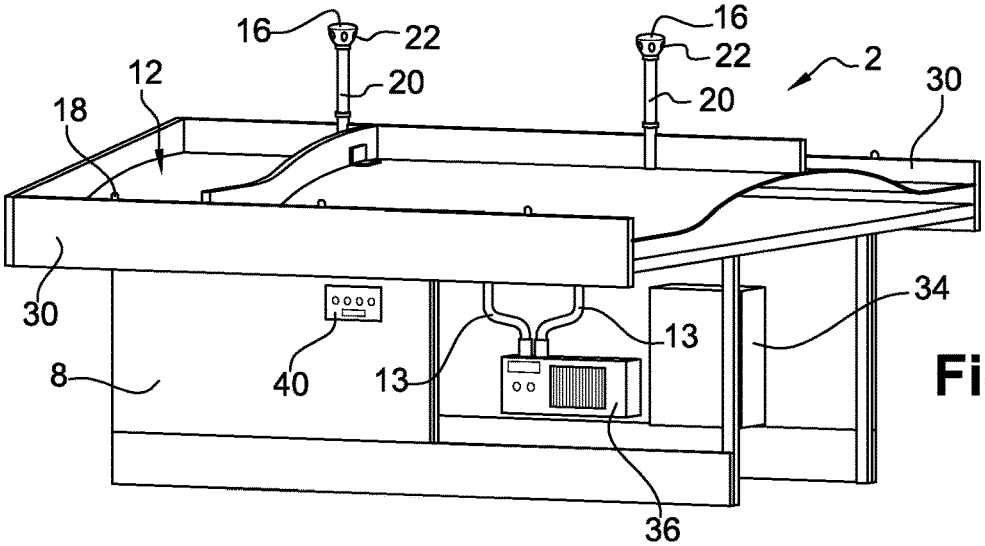
Figure 3:
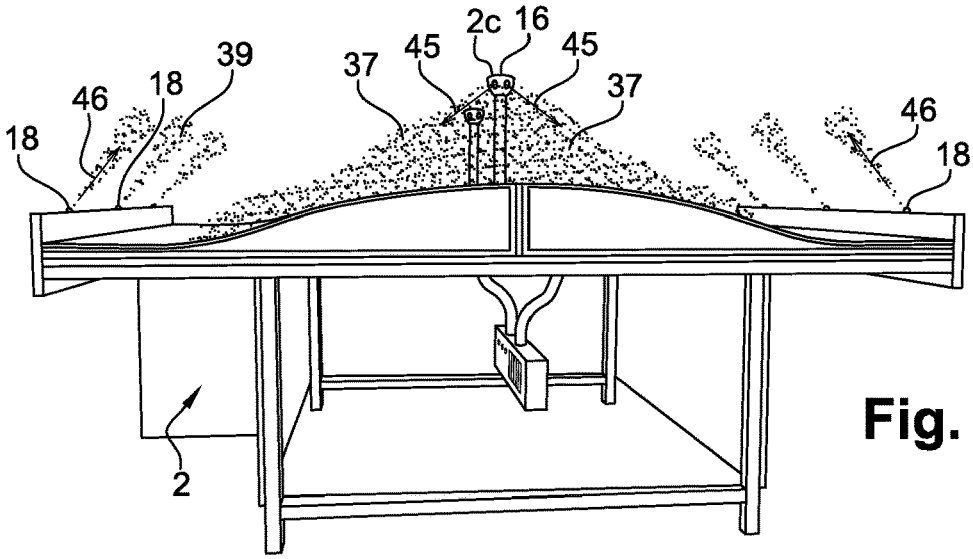
Figure 4:
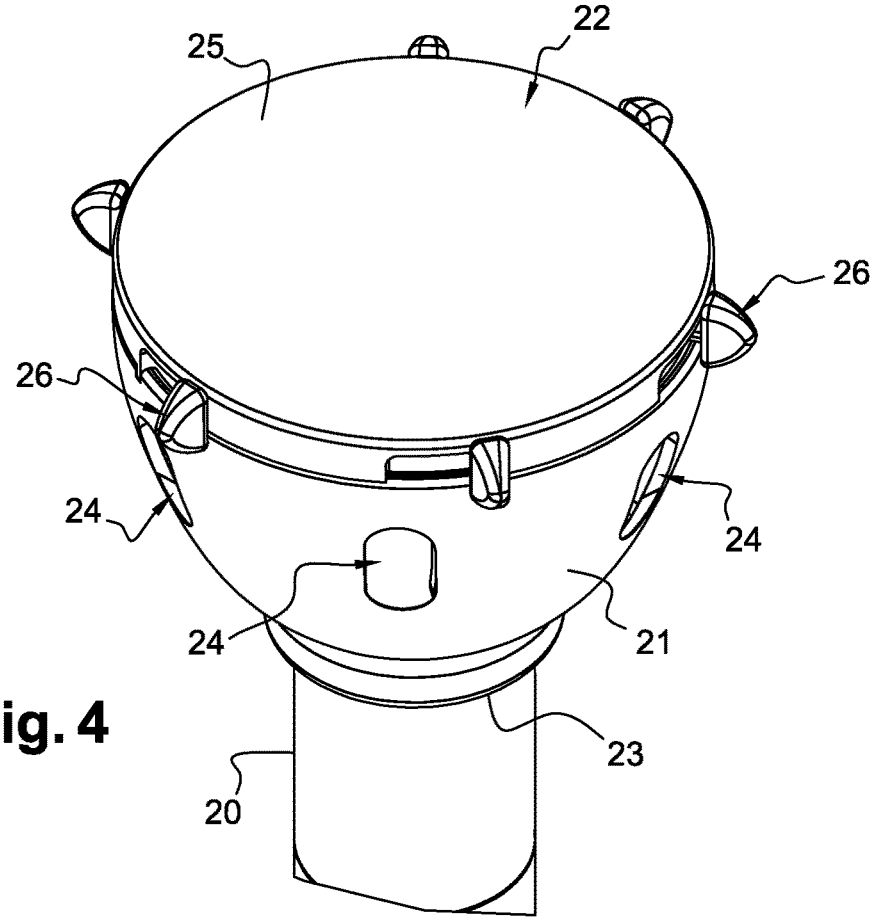
FIGS. 4 to 7 are perspective views in axial section of one of the diffusing heads of the installation in the preceding figures.
Figure 5:
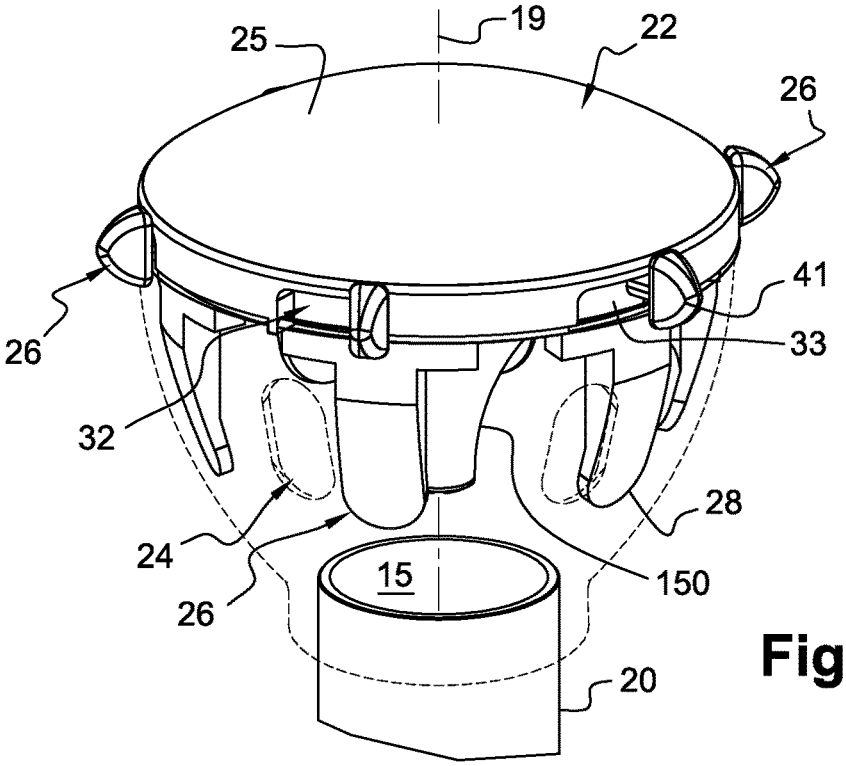
Figure 6:
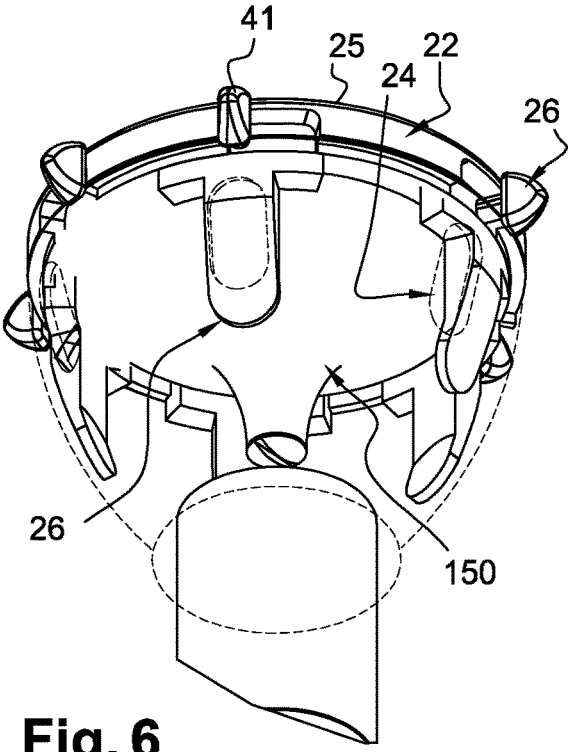

FIGS. 2 and 3 illustrate some of the equipment for generating the mist of water droplets and the way in which it is fed to each of the diffusers. Thus, the frame 8 carries an electrical power supply unit 34 which powers a mist generator 36.

The latter comprises one or more ultrasound emitters that are equipped for example with an acoustic concentration nozzle that is used to produce the mist formed by the water microdroplets which are then put into suspension in an air flow. The generator is supplied with water by a suitable means. Such a generator is known per se, notably from document FR-2 788 706 and will not be described further here. It is also possible to this end to use technology employing a micro-perforated membrane.

The mist thus produced comprises microdroplets, the dimensions of which are between 0.2 and 50 μm, preferably between 2 and 5 μm. Preferably, a majority of droplets, up to 95% thereof, have a largest dimension of less than 5 μm.

The installation comprises a set of ducts 13 by means of which the mist produced by the generator is transmitted to the diffusers 16 and 18.

The assembly is controlled by means of a unit 40 for controlling and regulating the operation of the piece of furniture. The unit makes it possible notably to regulate the ventilation rate, that is to say the speed of the air forming a part of the mist, the nebulization power and other parameters of the machine (cycle, safety thresholds, etc.).

FIG. 3 illustrates the piece of furniture in operation, the products having been omitted in order to see the diffusion of the mist better. All of the diffusers diffuse jets of mist 37, 39 simultaneously through their orifices, above the bottom wall 12 and the products. The diffusers 16 diffuse their jets 37 through their orifices 24. The mist is produced all around the diffuser 16 and downward in the direction of the bottom wall 12 and the products 4, 6.

The head 22 will now be described in more detail. In the various embodiments, similar elements have reference numerals increased by 100.

First Embodiment

This first embodiment of the head 22 is illustrated in FIGS. 4 to 11.

The head has an axisymmetrical overall shape about the axis 19 of the pole. It comprises a body 21 formed in this case by a bowl, the wall of which has, in section in a radial plane with respect to the axis 19, a circular arc shape, the center of curvature of which is located inside the bowl. The bowl has a flared and rounded shape, its diameter increasing from the base of the bowl to its upper edge. This shape makes it possible to orient the orifices 24 downward.

At its lower end, the bowl 21 has a lip 23 by way of which it is threaded onto the upper end of the pole with the head coaxial with the pole. This lip delimits a lower mouth 15 for the mist coming from the pole to enter the head. A mouth is understood to be an opening which is formed at a lower end of the bowl 21 and through which the mist coming from the pole 20 passes when the head 22 is threaded onto the pole 20. This mouth 15 is clearly distinguishable on the head 22 when it is no longer threaded onto the pole 20.

The bowl 21 has a circular upper opening that extends in a plane perpendicular to the axis 19 and is closed in a leaktight manner by a cover or removable lid 25 having a lip slotted into the opening in the bowl.

The orifices 24 have in this case an elongate shape in the vertical direction so as to give them the appearance of a slot. In this example, they are mutually identical and are situated at the same height, being distributed regularly around the vertical axis of symmetry of the diffuser. They pass through the wall of the bowl from the inside to the outside. There are six of these orifices here, but this number may be varied and be for example two, three, four or five or even more than six. The axis of each orifice is inclined with respect to the vertical and horizontal directions. The bowl delimits an internal cavity 17 of the head. Each orifice 24 puts the inlet mouth 15 into communication with the outside of the head via the common cavity 17, independently of the other orifices 24.

The head 22 has closing means 26 associated with the respective orifices 24, there being the same number of closing means 26 as the latter. The closing means are able to close the respective orifices, each closing means being able to close one of the latter. The closing means are mutually identical. They are mounted in a movable manner with respect to the bowl, independently of one another. In this case, they are mounted so as to rotate with respect to the bowl about the same vertical axis formed by the axis 19. The closing means 26 are not able to close the lower mouth 15. The head 22 does not have means for closing the lower mouth 15.

Each closing means 26 comprises a plug 28 extending inside the head and an operating button 41 extending outside the head.

The cover has a lower lip having external and internal cylindrical faces with a circular section in a plane perpendicular to the axis 19. Formed in this lip are the same number of circumferential through-openings 32 as there are closing means, said through-openings 32 receiving the latter. The openings 32 are downwardly open at the lower edge of the cover that comes into contact with the upper edge of the bowl and each have a rectangular overall shape.

Each closing means 26 extends through one of the openings, the joining zone between the plug and the button extending in the opening. The joining zone also comprises an internal guide portion 33 having a cylindrical external face with a circular section in a plane perpendicular to the axis 19 and having the same radius as the internal face of the lip of the cover so as to produce surface contact with said internal face. The button 41 furthermore bears by way of its internal face against the deflector, as will be seen below.

Each plug 28 has an external face which is in surface contact with the internal face of the bowl and is able to close all of the associated orifice 24. This is the closing position taken up by the closing means when it is in abutment against one of the circumferential ends of the opening 32. By contrast, when it is in abutment against the other end of the opening, the plug leaves the orifice entirely free. The closing means is then in the open position.

The installation operates in the following manner. The mist generator produces a mist of nebulized water droplets in suspension in an air flow, which is fed from bottom to top through the pole 20 to the mouth 15 and then enters the cavity 17 in the head. The mist then exits the head through only those orifices 24 of which the closing means are in the open position, if there is one. The mist does not exit through the orifices of which the closing means are in the closed position, if there is one. Given that the orifices are distributed all around the head, it is thus possible to select the direction(s) in which the mist is diffused and thus the zone(s) of the display which receive it. At any time, one of the buttons 41 can be operated in order to place the closing means in the open or closed position, independently of the other closing means. It is also possible to put all of the closing means in the open position in order that the mist is diffused simultaneously through all the orifices 24. By contrast, it is possible to close all of the orifices in order to prevent any diffusion of the mist through the head, and for example reserve this diffusion for another head of the installation.

Figure 7:
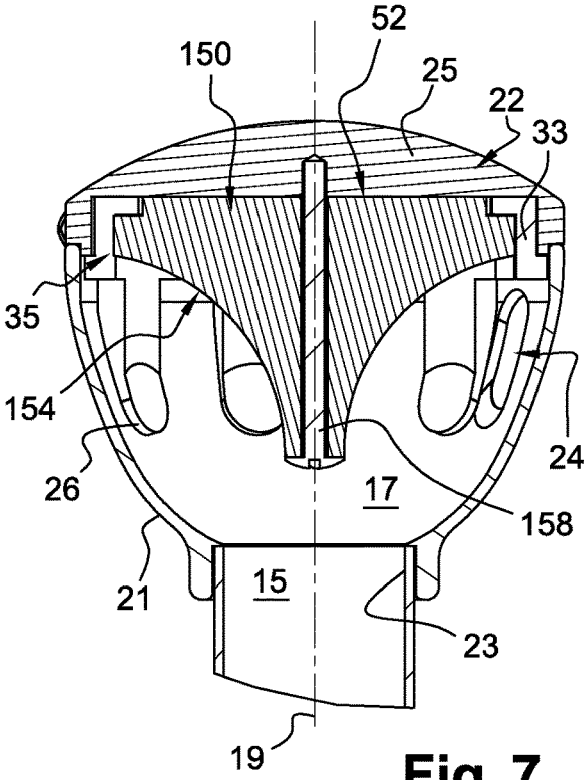
Figure 8:
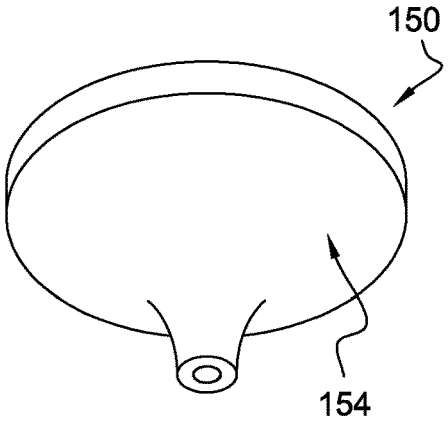
FIGS. 8 to 11 are perspective views in axial section of the deflector of the head in FIGS. 4 to 7.
Figure 9:
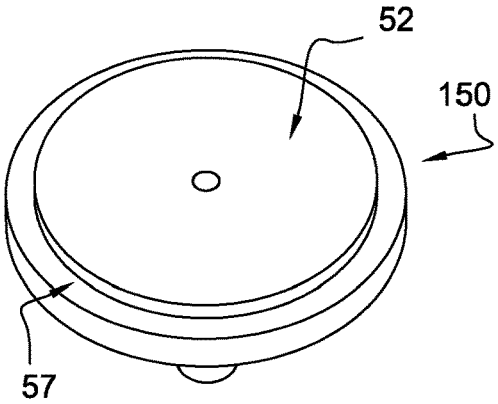
Figure 10:
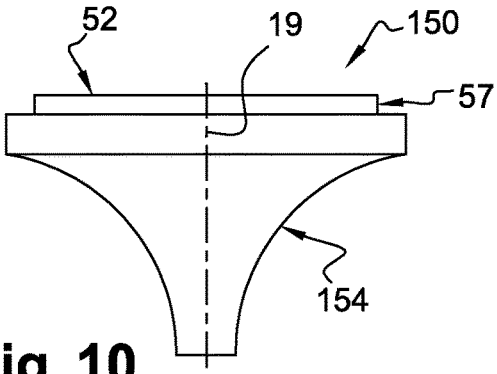

As illustrated in FIG. 7, it is also possible to put at least any one of the closing means in an intermediate open position of the associated orifice. In this case, this position can be any position between the completely open position and the completely closed position. The closing means is held in this position by friction. In such an intermediate open position, the flow rate of mist through the orifice is generally proportional to the section of the orifice which is thus left free by the closing means.

By virtue of the shape given to the bowl and to the closing means, if condensation arises inside the head, notably on the closing means, none of this condensation flows out of the head. It flows entirely in the head and inside the pole.

Figure 11:
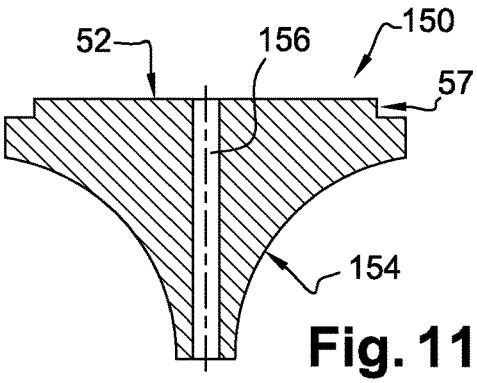
Figure 12:
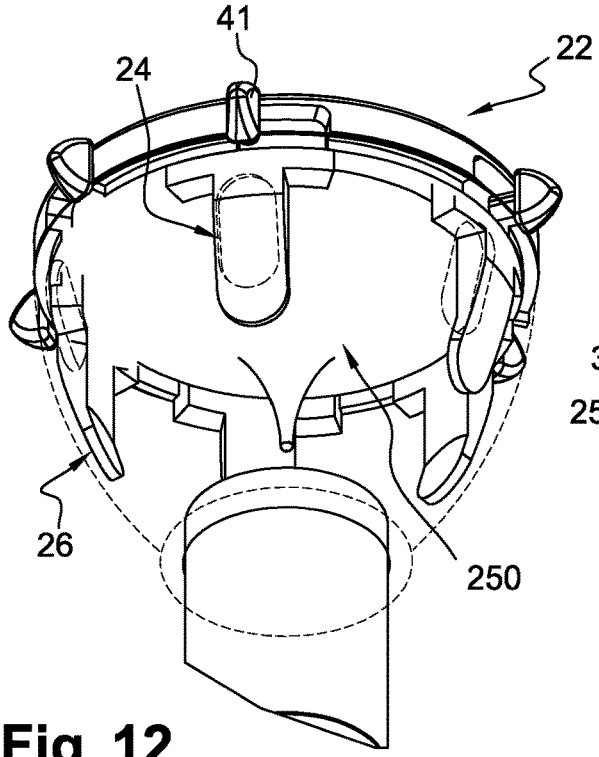
FIGS. 12 to 16 are views similar to FIGS. 6 to 11, illustrating a second embodiment of the head.
Figure 13:
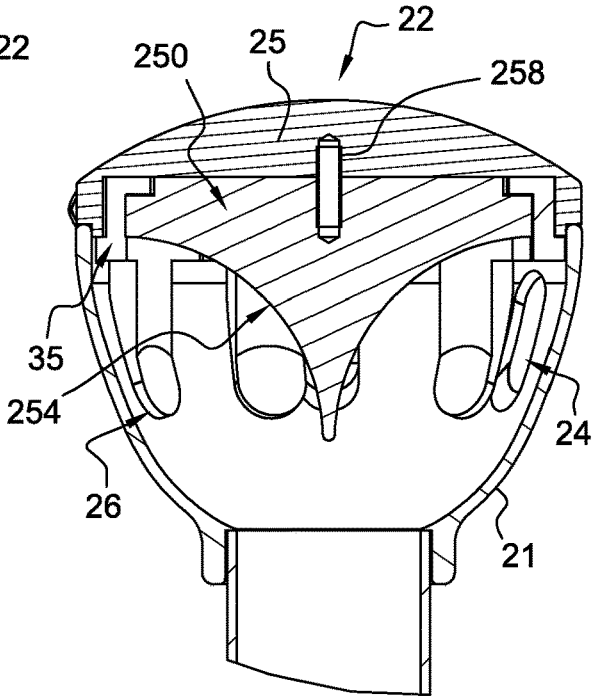
Figure 14:
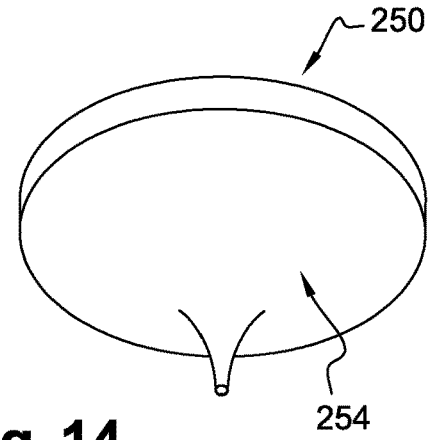
Figure 15:
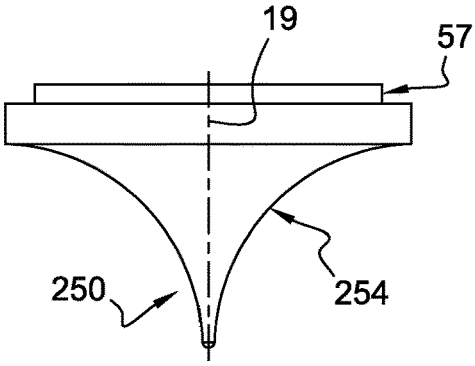
Figure 16:
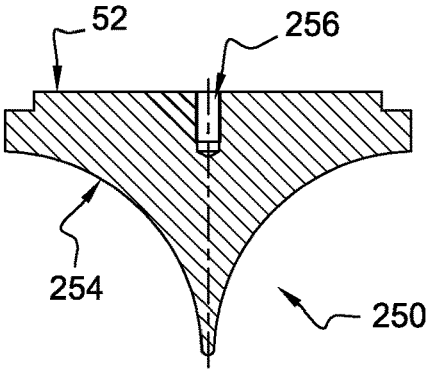
Figure 17:
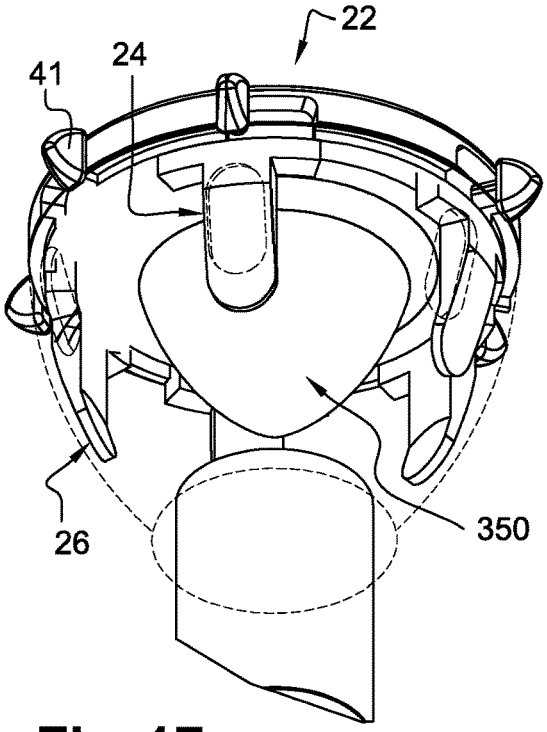
FIGS. 17 to 21 are views similar to FIGS. 6 to 11, illustrating a third embodiment of the head.
Figure 18:
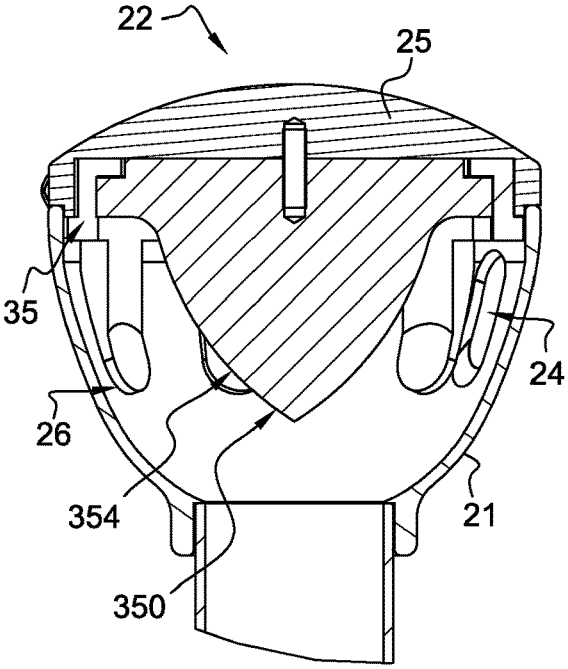
Figure 19:
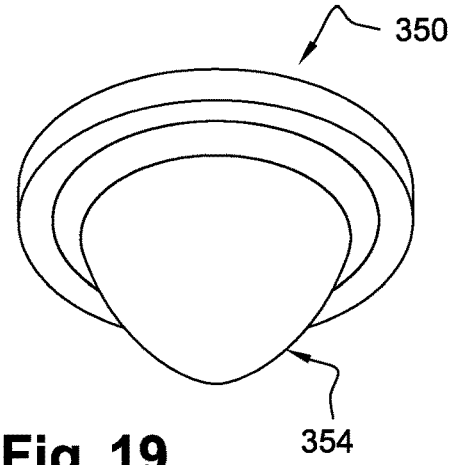
Figure 20:
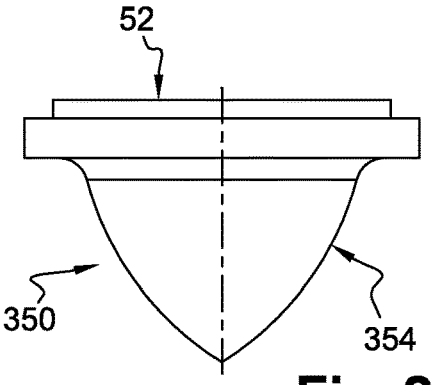
Figure 21:
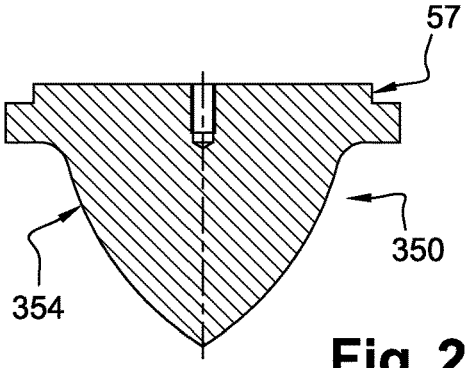

The head 22 also comprises an axisymmetrical deflector 150 that is disposed in the head coaxially with the bowl. The deflector has a flat upper main face 52 in the form of a disk and a non-flat lower main face 154 in this case having a concave curved profile in a radial plane with respect to the axis 19, as illustrated in FIGS. 7 and 11. In this case, this profile has a parabolic shape. The center of curvature is located at this face opposite the deflector per se, that is to say outside the deflector in this case. This profile does not have any point of inflection.

The main face 154 thus has, at any point on its surface, a normal oriented in a direction other than the direction of the mouth. This normal direction is generally oriented toward the wall of the bowl, or even toward the orifices 24. Thus, the entire part of this face that is situated opposite the mouth 15 is not oriented in the direction of the latter. The deflector is disposed in the cavity 17 such that its upper face 52 is in surface contact with a lower face of the cover 25. It is dimensioned such that its lower face 154 then extends opposite all the orifices 24. Thus, each of these orifices extends entirely opposite this face.

The deflector comprises a central cylindrical duct 156 that extends through the entire height of the deflector from the face 52 to the face 154. The deflector is fixed rigidly and directly to the cover by means of a fixing member such as a screw 158, the head of which in this case bears against the lower end of the deflector and the free end of which passes into the cover, the screw passing through the entire height of the duct 156. It will be seen notably that the deflector 150 is connected to the wall of the head and to the cover independently of the closing means.

The deflector has a circumferential peripheral shoulder 57 recessed from its upper face 52. This shoulder cooperates with the lip of the cover situated opposite and at a distance from the latter in order to delimit a housing with an L-shaped section 35. The internal guide portion 33 of each closing means is received in this housing and has to this end a profile with a complementary shape. Thus, the closing means are mounted so as to rotate about the axis 19, being guided by the cover and the deflector, between the latter. By way of this means, they are also fixed to the cover and to the deflector such that it is possible to extract the cover, the closing means and the deflector as one in order to access the inside of the head.

During operation of the installation, the mist passes into the head through the mouth 15 and is then guided by the lower face 154 of the deflector and by the internal face of the bowl 21 to each of the orifices 24 which are open. The face 154 thus modifies the orientation of the mist as it passes through the head without excessively reducing its speed or, consequently, its pressure.

The screw head and the lower end of the deflector extend above the mouth 15. As a result, if condensation of liquid arises on the deflector, the liquid flows into the pole 20 by gravity.

In this case, the deflector is produced in the form of a solid part made of plastics material, for example polytetrafluoroethylene (for example the materials sold under the name "Teflon" or "Viton" by DuPont de Nemours), this being preferred for its hydrophobic properties.

Second Embodiment

A second embodiment of the installation according to the invention will now be described with reference to FIGS. 12 to 16. This installation is identical to that of the preceding embodiment apart from the shape of the deflector.

The deflector 250 differs from that of the preceding embodiment only in two aspects. Firstly, the lower face 254 is closer to the axis 19 than the face 154 was. In addition, the duct 256 is reduced this time to a blind duct that is recessed from the upper face 52 of the deflector and passes into the latter only over a fraction of its height. The member 258 used this time to rigidly fix the deflector to the cover is formed by a threaded rod that passes into said deflector and cover.

This time, it is thus the lower tip of the deflector which constitutes the lower end thereof and which extends above the mouth 15 in order to allow the flow of condensed liquid, if need be.

The operation of the installation and of the head is similar to that of the preceding embodiment, but with a reduced area of impact of the mist coming from the mouth 15 against the lower face 254.

Third Embodiment

FIGS. 17 to 21 illustrate a third embodiment of the installation according to the invention. This installation is identical to that of the preceding embodiment apart from the shape of the lower face of the deflector 350.

Specifically, this face 354 this time has a domed convex shape. The curved profile in the form of a circular arc is thus disposed such that its center of curvature is located on the same side of this face as the deflector, that is to say inside the deflector in this case.

The operation of the installation in general and of the head in particular is similar to that of the preceding embodiment, but with a different mist guiding technique than the two preceding embodiments.

Results

Figure 22:
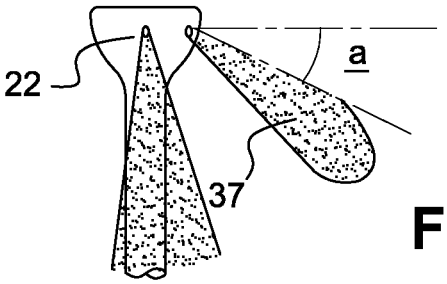
FIGS. 22 to 25 are elevation views of the head at the top of its pole, showing the orientation of the jet(s) of mist out of the head in the absence of a deflector and for the three abovementioned embodiments, respectively.
Figure 23:
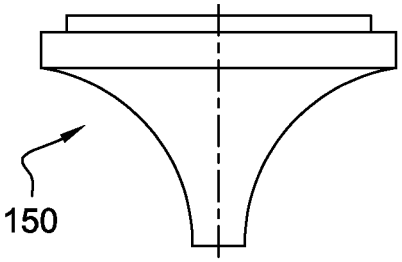
Figure 23:
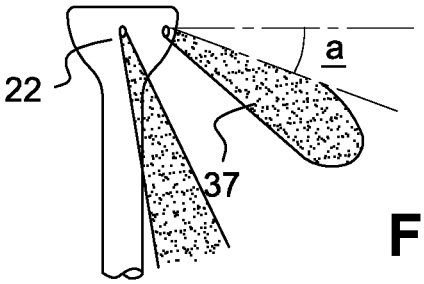
Figure 24:
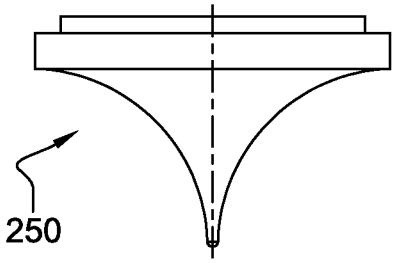
Figure 24:
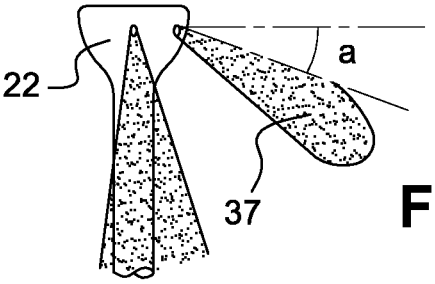
Figure 25:
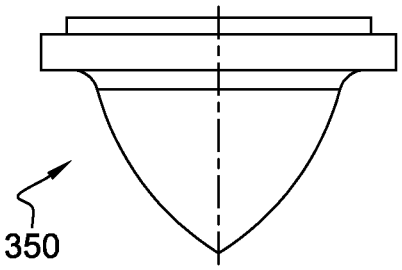
Figure 25:
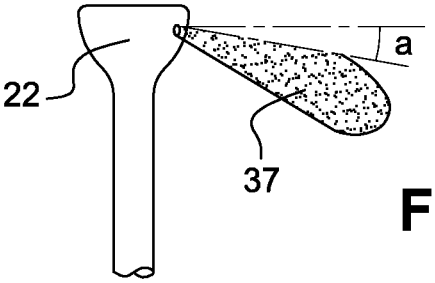

FIGS. 22 to 25 illustrate four different diffusers 22 in operation during tests. In FIG. 22, the diffuser does not comprise a deflector in its head. Consequently, when the jet of mist passes into the cavity 17, it butts against the lower flat face of the cover. In FIGS. 23 to 25, the head is in each case in accordance with one of the three embodiments which have just been described. The plane of each of the figures intersects the axis 19 of the pole for the one part and the main axis of one of the orifices and of the corresponding jet of mist for the other part. The test conditions are the same in all four cases. In particular, the head is supplied through the mouth with an identical flow rate of mist. In addition, apart from the presence or absence of a deflector and if need be the shape thereof, the head 22 is identical in all four tests.

In the case of FIG. 22, the jet of mist 37 leaves the orifice at a speed of 1.9 m/s and its direction with respect to the horizontal forms an angle a of 30°. Assuming that the head is located 30 cm from the receiving plane of the droplets, the range of the jet of mist is 0.28 m.

In the case of FIG. 23, the speed of the jet of mist is 2.2 m/s this time and the angle a is reduced to 22°. The range of the jet of mist is 0.36 m this time, this being consistent with the fact that the jet of mist is both faster and more concentrated. Losses of water are reduced by 2% to 3% compared with the case in FIG. 22.

The same values are obtained with the head in FIG. 24.

Finally, with the head in FIG. 25, the outlet speed is 1.9 m/s, the angle a is 10° and the theoretical range 0.40 m. Losses of water are reduced by 1% to 2% compared with the case in FIG. 22.

It can thus be seen that the presence of the deflector can have different effects that are likely to accumulate. It makes it possible to concentrate the jet of mist by reducing its inclination with respect to the horizontal direction, this resulting in an increase in its range, as is the case for the three embodiments of the invention. It can increase the outlet speed of the mist from the head, as is the case in FIGS. 23 and 24.

These results come notably from the fact that the deflector tends to reduce turbulence in the flow of mist inside the head and helps to make it laminar.

The increase in the speed of the jet and the reduction in its inclination with respect to the horizontal direction mean that it is less disturbed by possible currents of air. In addition, it is possible to dispose the diffusers at a relatively low height where the currents of air are less likely to occur.

In the embodiment in FIG. 24, it will be observed that, in some cases, each orifice produces two different jets of mist that differ by way of their different inclinations with respect to the horizontal direction. This can be useful for refreshing products disposed at relatively short and long distances from the diffuser.

The invention has the advantage of being applicable to existing heads. This is because it is sufficient to add a deflector to the latter. Similarly, depending on the circumstances of use of one and the same head, it is possible to modify the jets of mist that it produces by replacing its deflector with a deflector with a different shape.

Of course, numerous modifications could be made to the invention without departing from the scope thereof.

The installation does not necessarily form a piece of furniture. It can be used in a place of storage or production, for example a place in which wine is made or cheese is ripened. It can constitute an installation for manufacturing and/or packaging.

The installation can also be used to disinfect or wet products or volumes, for example of products traveling on a conveyor belt, notably in a production line or packaging line. Thus, the mist of droplets can be formed from a liquid containing a biocide.

The shape, number and dimensions of the orifices and of the closing means could be modified. In particular, circular orifices can be provided. The diffusers can be able to move and in particular rotate about the vertical axis. The shape and the dimensions of the diffusers can be modified.

The deflector can have a shape other than an axisymmetrical shape. Its lower face could have a non-curved profile, for example comprising one or more line segments. In the case of a curved profile, the latter could have at least one point of inflection and have an S-shaped overall shape.

The invention is also applicable to a mist diffusing head that does not have a closing means. This is notably a mist diffusing head for a nebulizing installation, which comprises:

a mouth for supplying the head with mist, an external wall that has at least one mist outlet orifice, the head not having means for closing the orifice, and a deflector that has, opposite the mouth, a main face that has at least one portion oriented in a direction other than the direction of the mouth.

Provision can be made for this head not to have means for closing the mouth for supplying the head with mist.

An assembly comprising a mist diffusing head and at least two diffusers with different shapes that are likely to be mounted in the head as desired, depending on the properties desired for the jets of mist leaving the head, could also be provided.

The invention claimed is:

1. A nebulizing installation comprising:

a mist diffusing head; and a mouth outside the mist diffusion head and configured to supply the mist diffusing head with mist, the mist diffusing head including:

an external wall having at least one mist outlet orifice, wherein each of the at least one mist outlet orifice has an axis which is inclined with respect to the vertical and horizontal directions of the mist diffusing head, a lid closing an upper opening of the external wall, at least one plug configured to close the at least one mist outlet orifice, and a single deflector connected to the external wall independently of the at least one plug and having, opposite the mouth, a main face having at least one portion oriented in a direction other than a direction of the mouth, a majority of the at least one mist outlet orifice extending opposite the deflector, wherein the at least one plug abuts the single deflector and is between the external wall and the single deflector, wherein the at least one plug is mounted in a movable manner with respect to the at least one mist outlet orifice, the at least one plug being guided against the deflector and the lid.

2. The nebulizing installation of claim 1, wherein the deflector has, opposite the at least one mist outlet orifice, a face with a curved profile in a radial plane with respect to a main axis of the deflector, the curved profile not having a point of inflection and having a parabolic shape.

3. The nebulizing installation of claim 1, wherein the deflector has, opposite the at least one mist outlet orifice, a face with a convex profile in a radial plane with respect to a main axis of the deflector.

4. The nebulizing installation of claim 1, wherein the deflector has, opposite the at least one mist outlet orifice, a face with a concave profile in a radial plane with respect to a main axis of the deflector.

5. The nebulizing installation of claim 1, wherein:

at least two mist outlet orifices are each configured to put the mouth into communication with the outside of the head, and at least two plugs are configured to close the respective mist outlet orifices, each plug being configured to close one of the mist outlet orifices, the plug being mounted in a movable manner with respect to the external wall independently of one another.

6. The nebulizing installation of claim 1, wherein the single deflector is fixed rigidly to the lid.

7. The nebulizing installation of claim 1, wherein the mist is generated outside of the mist diffusing head.

8. The nebulizing installation of claim 1, wherein the mouth and the at least one mist outlet orifice are configured such that the mist flows sequentially through the mouth and through the at least one mist outlet orifice.

9. The nebulizing installation of claim 1, wherein:

the external wall includes a plurality of mist outlet orifices; and all of the plurality of mist outlet orifices extend opposite the single deflector.

10. A method for diffusing a mist of droplets from the mist diffusing head of claim 1, the method comprising:

creating the mist outside the mist diffusing head; and supplying mist to the mist diffusing head.

11. The method of claim 10, wherein the mist flows sequentially through the mouth and through the at least one mist outlet orifice.

12. A nebulizing installation comprising:

a mist diffusing head; and a mouth outside the mist diffusion head and configured to supply the mist diffusing head with mist, the mist diffusing head including:

an external wall having at least one mist outlet orifice, a lid closing an upper opening of the external wall, at least one plug, mounted so as to rotate about a central axis of the mist diffusing head with respect to the external wall, configured to close the at least one mist outlet orifice, and a single deflector connected to the external wall independently of the at least one plug and having, opposite the mouth, a main face having at least one portion oriented in a direction other than a direction of the mouth, a majority of the at least one mist outlet orifice extending opposite the deflector, wherein the at least one plug abuts the single deflector and is between the external wall and the single deflector, wherein the at least one plug is mounted in a movable manner with respect to the at least one mist outlet orifice, the at least one plug being guided against the deflector and the lid.

* * * * *